US011602172B2

(12) United States Patent
Xiao et al.

(10) Patent No.: US 11,602,172 B2
(45) Date of Patent: Mar. 14, 2023

(54) POROUS COMPONENT AND ELECTRONIC CIGARETTE INCLUDING THE SAME

(71) Applicant: SHENZHEN SMOORE TECHNOLOGY LIMITED, Shenzhen (CN)

(72) Inventors: Congwen Xiao, Shenzhen (CN); Zhenlong Jiang, Shenzhen (CN); Hongliang Luo, Shenzhen (CN); Lingrong Xiao, Shenzhen (CN); Xiaoping Li, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 405 days.

(21) Appl. No.: 16/942,971

(22) Filed: Jul. 30, 2020

(65) Prior Publication Data

US 2021/0030066 A1 Feb. 4, 2021

(30) Foreign Application Priority Data

Aug. 2, 2019 (CN) ..... 2019107119654

(51) Int. Cl.
*A24F 40/44* (2020.01)
*A24F 40/46* (2020.01)

(52) U.S. Cl.
CPC ..... *A24F 40/44* (2020.01); *A24F 40/46* (2020.01)

(58) Field of Classification Search
None
See application file for complete search history.

(56) References Cited

U.S. PATENT DOCUMENTS

| | | | | |
|---|---|---|---|---|
| 2016/0021930 | A1* | 1/2016 | Minskoff | A24F 40/51 392/395 |
| 2017/0127723 | A1* | 5/2017 | Wu | A24F 40/44 |
| 2017/0340012 | A1* | 11/2017 | Mironov | H05B 3/26 |
| 2021/0030066 | A1* | 2/2021 | Xiao | H05B 1/0227 |

FOREIGN PATENT DOCUMENTS

| | | | |
|---|---|---|---|
| CN | 103929984 | A | 7/2014 |
| CN | 104470387 | A | 3/2015 |
| CN | 104768407 | A | 7/2015 |
| CN | 108338416 | A | 7/2018 |

* cited by examiner

*Primary Examiner* — James Harvey
(74) *Attorney, Agent, or Firm* — Dorsey & Whitney LLP

(57) ABSTRACT

The present disclosure relates to a porous component and an electronic cigarette including the same. The porous component includes a porous substrate, an atomizing portion located on the porous substrate; a liquid guiding portion located on the porous substrate, a porosity of the liquid guiding portion being greater than a porosity of the atomizing portion; and a functional portion located on the porous substrate. A porosity of the functional portion is greater than a porosity of the liquid guiding portion, and a thermal conductivity of the functional portion is greater than a thermal conductivity of the atomizing portion and the liquid guiding portion.

20 Claims, 5 Drawing Sheets

POROUS COMPONENT AND ELECTRONIC CIGARETTE INCLUDING THE SAME

CROSS-REFERENCE TO RELATED APPLICATION

This application claims priority to Chinese Patent Application No. 2019107119654 filed on Aug. 2, 2019, the entire contents of which is incorporated herein by reference.

TECHNICAL FIELD

The present disclosure relates to a field of electronic cigarette technology, in particular, to a porous component and an electronic cigarette including the same.

BACKGROUND

Electronic cigarette products have developed into a major substitute to traditional tobaccos, and have a variety of types. Atomizer, as a core component of the electronic cigarette products, is usually composed of three parts: a liquid reservoir, a liquid guiding component, and an atomizing component. The liquid guiding components on the market are mainly made of three types of materials: fiber rope, liquid-guiding cotton, and porous ceramic. These types of materials all have very well-developed microporous structures. Liquid in the liquid reservoir is transmitted to the atomizing component subjected to infiltration and capillary effect of micropores in the liquid guiding component, and then is atomized via heating, vibration or the like of the atomizing component.

Structures and property of the micropores in the liquid guiding component directly determine its thermal conduction and liquid guiding capabilities, which are the key factors affecting the quality of an atomizer and the taste of smoke. By changing the type of materials and processing methods, the structures and property of the liquid guiding component can be changed to a certain extent. However, such methods are to adjust the liquid guiding component as a whole, some specific properties are improved, usually at the cost of other properties, and it is impossible to achieve a balanced improvement in the overall property of the atomizer.

SUMMARY

According to various embodiments, a porous component is provided.

A porous component for an electronic cigarette includes: a porous substrate; an atomizing portion located on the porous substrate; a liquid guiding portion located on the porous substrate, a porosity of the liquid guiding portion being greater than a porosity of the atomizing portion, and a functional portion located on the porous substrate. A porosity of the functional portion is greater than a porosity of the liquid guiding portion, and a thermal conductivity of the functional portion is greater than a thermal conductivity of the atomizing portion and the liquid guiding portion.

An electronic cigarette includes the porous component as described above.

Through the porous component formed by combining the atomizing portion, the liquid guiding portion with the functional portion capable of ventilation and/or thermal conduction, and changing the material characteristics of the atomizing portion, the liquid guiding portion and the functional portion, it can achieve a balanced improvement in the overall property of the atomizer, and save the space occupied by the atomizer.

These and other objects, advantages, purposes and features will become apparent upon review of the following specification in conjunction with the drawings.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION OF THE EMBODIMENTS

Figure 1:
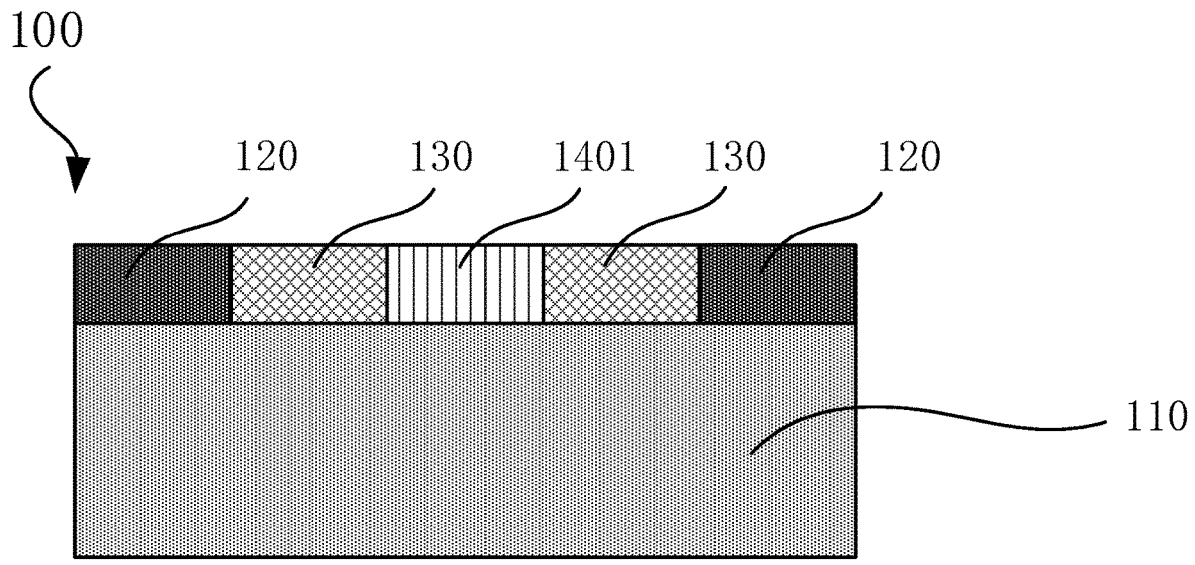
FIG. 1 is a cross-sectional view of a porous component according to an embodiment.

For the convenience of understanding of the present disclosure, the present disclosure will be described more fully with reference to related drawings. The preferred embodiments of the present disclosure are illustrated in the drawings. However, the present disclosure can be implemented in many different forms and is not limited to the embodiments described herein. In contrast, providing these embodiments is to providing a fully and thoroughly understanding of the disclosure of the present disclosure.

It should be noted that when an element is referred as to be "fixed" to another element, it can be directly on another element or there may be an intermediate element therebetween. When an element is considered to be "connected" to another element, it may be directly connected to another element or there may be an intermediate element therebetween at the same time. The terms "vertical", "horizontal", "left", "right" and the like used herein are for illustration only and are not meant to be the only embodiment.

Unless otherwise defined, all technical and scientific terminologies used herein have the same meaning as commonly understood by those skilled in the technical field of the present disclosure. The terminology used in the description of the present disclosure herein is for the purpose of describing specific embodiments, and is not intended to limit the present disclosure.

An electronic cigarette according to an embodiment includes a porous component 100. Referring to FIGS. 1 to 6, the porous component 100 includes a porous substrate 110, an atomizing portion 120, a liquid guiding portion 130, and a functional portion 140 that are located on the porous substrate 110.

The porous substrate 110 has a porous structure for storing liquid. A pore size of the porous structure may be in a range from 10 μm to 50 μm. A porosity of the porous substrate 110 may be in a range from 30% to 70%. Further, the porous substrate 110 is made of porous ceramic or porous metal. When the porous substrate 110 is made of porous metal, the porous substrate 110 can also be connected to a power source to generate heat for atomization. The porous ceramic may be at least one selected from a group consisting of porous alumina ceramic, porous silica ceramic, the porous zirconia ceramic, porous silicon nitride ceramic, porous cordierite ceramic, porous silicon carbide ceramic, porous aluminum titanate ceramic, porous spodumene ceramic, and porous mullite ceramic. The porous metal may be at least one selected from a group consisting of porous stainless steel, porous iron-chromium aluminum alloy, porous nickel, porous nickel-chromium alloy, porous titanium alloy, porous aluminum alloy, porous platinum alloy, and porous silver alloy.

The atomizing portion 120 is used to atomize liquid. A porosity of the atomizing portion 120 may be less than 20%, more specifically less than 10%. The atomizing portion 120 may be made of a material having a dense structure or a microporous structure. When the atomizing portion 120 is made of a material having the microporous structure, the pore size thereof may be in a range from 5 μm to 30 μm. Moreover, the atomizing portion 120 is made of at least one selected from a group consisting of alumina ceramic, silicon oxide ceramic, zirconia ceramic, silicon nitride ceramic, cordierite ceramic, silicon carbide ceramic, aluminum titanate ceramic, spodumene ceramic and mullite ceramic.

The liquid guiding portion 130 is used to guide the liquid, so as to supply the liquid to the atomizing portion 120. A porosity of the liquid guiding portion 130 is greater than that of the atomizing portion 120, such that the guiding effect can be achieved. A porosity of the liquid guiding portion 130 may be in a range from 20% to 60%, more specifically 30% to 40%. The liquid guiding portion 130 may be made of a material with high porosity. The pore size thereof may be in a range from 10 μm to 50 μm. Moreover, the liquid guiding portion 130 is made of a ceramic material with high porosity. For example, the liquid guiding portion 130 is made of at least one selected from a group consisting of alumina ceramic, cordierite ceramic, diatomaceous earth ceramic, and silicon carbide ceramic.

When a plurality of liquid guiding portion 130 are provided, and porosities or liquid guiding speeds of the plurality of liquid guiding portion 130 may be different. The arrangement of the plurality of liquid guiding portion 130 can be configured according to the diffusion speed of different flavor and fragrance ingredients in the liquid, in such a way, the different flavor and fragrance ingredients in the liquid can be adjusted to be diffused into a heating portion in a specific order, thereby improving the sense of gradation of volatile smoke smell, improving the taste of the smoke. For example, the liquid guiding portion 130 corresponding to the flavor and fragrance ingredient that needs to be diffused first can be disposed closer to the atomizing portion 120, and the liquid guiding portion 130 corresponding to the flavor and fragrance ingredient that needs to be diffused later can be disposed away from the atomizing portion 120.

The functional portion 140 is connected to at least one of the atomizing portion 120 and the liquid guiding portion 130. In other words, the functional portion 140 may be only connected to the atomizing portion 120, may be only connected to the liquid guiding portion 130, or may be connected to the both. The functional portion 140 includes at least one of the first functional portion 1401 and a second functional portion 1402 for ventilation and/or thermal conduction. A porosity of the first functional portion 1401 may be greater than the porosity of the liquid guiding portion 130, such that the first functional portion 1401 may be used as a ventilation functional portion, which can enable the air to flow through the porous component quickly, so as to allow the atomized smoke to reach the user's mouth quickly. A thermal conductivity of the second functional portion 1402 may be greater than the thermal conductivity of the atomizing portion 120 and the liquid guiding portion 130, which can be used as a thermal conduction functional portion, for conducting the heat to the liquid.

The atomizing portion 120, the liquid guiding portion 130, and the functional portion 140 may be horizontally arranged on a side of the porous substrate 110. That is, the atomizing portion 120, the liquid guiding portion 130, and the functional portion 140 are each in contact with the porous substrate 110, the three together form a layered structure on the porous substrate 110. In this case, a preparing method of the atomizing portion 120, the liquid guiding portion 130, and the functional portion 140 may include: machining a plurality of holes on a surface of the porous substrate 110 by laser etching, and then filling the plurality of holes with a required functional material. The functional material may be filled by, for example, a directional freezing tape-casting method, an organic precursor impregnation method, a 3D printing method, and the like.

By combining the atomizing portion 120, the liquid guiding portion 130, and the functional portion 140, it is possible to achieve different effects with the porous structure module 100. The number of the atomizing portion 120, the liquid guiding portion 130, and the functional portion 140 may be one or more. Through designing or partially adjusting the arrangement of the atomizing portion 120, the liquid guiding portion 130 and the functional portion 140, the porous component 100 of the present disclosure can have excellent overall property.

Figure 2:
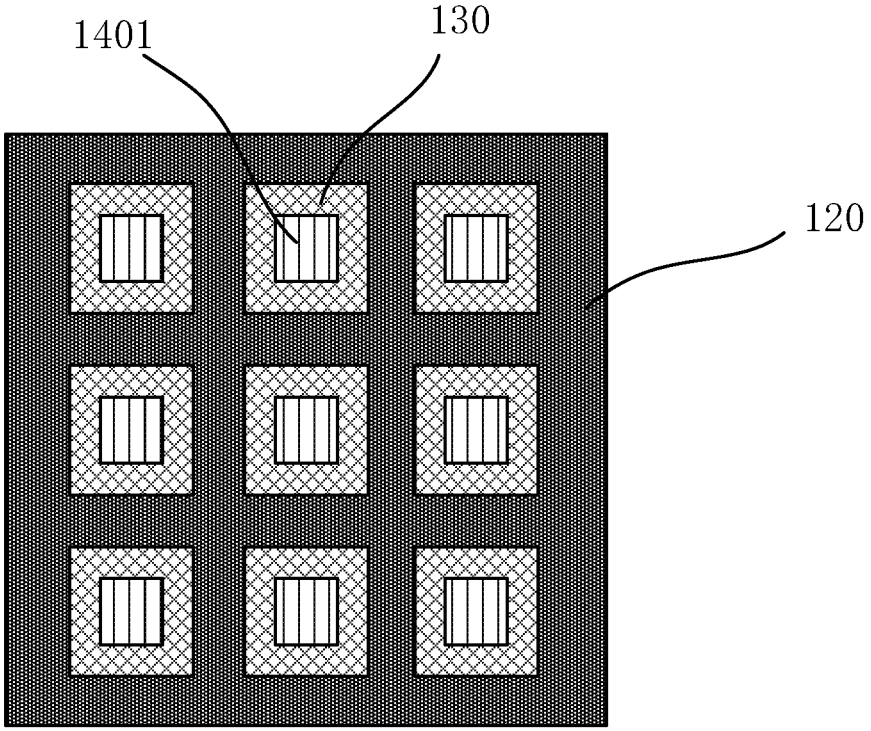
FIG. 2 is a top view of the porous component of FIG. 1.

In one of the embodiments, referring to FIGS. 1 and 2, the functional portion 140 includes a first functional portion 1401. The first functional portion 1401 is connected to the liquid guiding portion 130, and the liquid guiding portion 130 is connected to the atomizing portion 120. For example, the liquid guiding portion 130 may be respectively connected to the first functional portion 1401 and the atomizing portion 120 on both sides. The atomizing portion 120, the liquid guiding portion 130, and the first functional portion 1401 may be horizontally arranged on the side of the porous substrate 110. A porosity of the first functional portion 1401 may be in a range from 40% to 70%, more specifically 40% to 60%. The porosity of the first functional portion 1401 is greater than that of the liquid guiding portion 130, such that the first functional portion 1401 may be used as a ventilation functional portion, which can enable the air to flow through the porous component quickly, so as to allow the atomized smoke to reach the user's mouth quickly. The first functional portion 1401 may be made of a material with a large pore size. The pore size thereof may be in a range from 50 μm to 200 μm. Furthermore, the first functional portion 1401 is made of the alumina ceramic.

Moreover, a plurality of the liquid guiding portions 130 and a plurality of the first functional portions 1401 are provided, the number of the both are the same. Each of the first functional portions 1401 is surrounded by a corresponding liquid guiding portion 130, and the plurality of liquid guiding portion 130 are surrounded by the atomizing portion 120. Furthermore, referring to FIG. 2, the plurality of first functional portions 1401 are arranged in an array. Each of the first functional portions 1401 has a rectangular shape, each of the liquid guiding portions 130 is shaped as a rectangular frame shape, and the atomizing portion 120 has a grid shape. A side length of the first functional portion 1401 and a frame width of the liquid guiding portion 130 can be designed as required. When the porous component 100 adopts this configuration, it has the beneficial effects of high atomization speed and large smoke amount.

Figure 3:
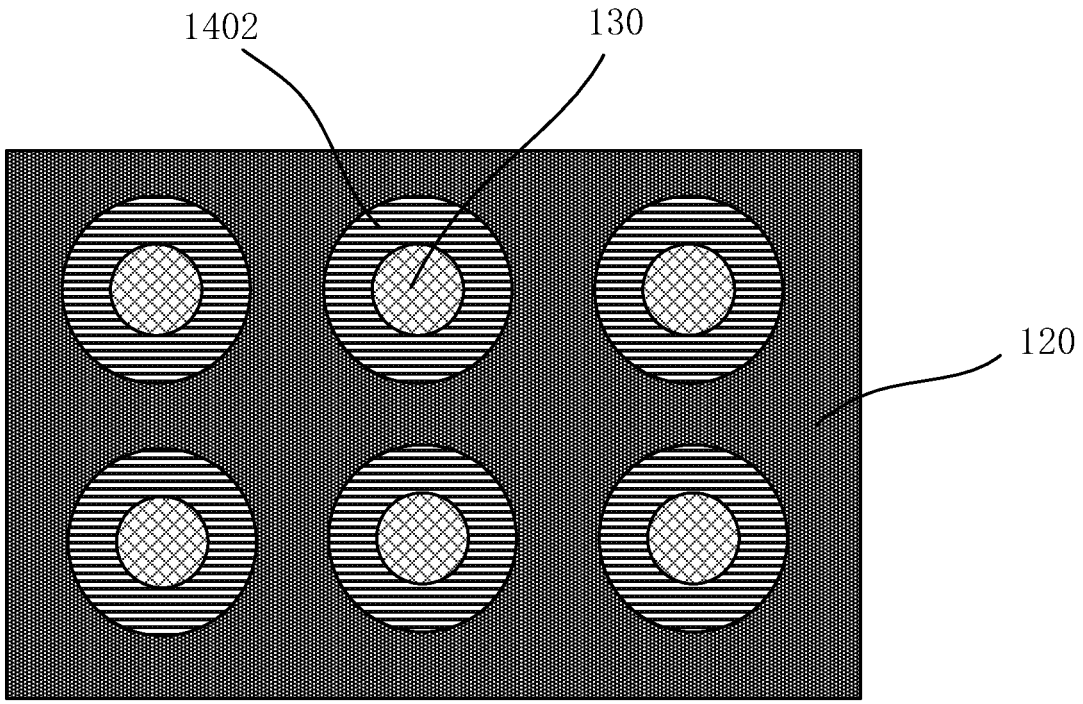
FIG. 3 is a top view of a porous component according to another embodiment.

In one of the embodiments, referring to FIG. 3, the functional portion 140 includes a second functional portion 1402. The second functional portion 1402 is connected to the atomizing portion 120 and the liquid guiding portion 130. The atomizing portion 120 and the liquid guiding portion 130 are connected to the second functional portion 1402, respectively. The atomizing portion 120, the liquid guiding portion 130, and the second functional portion 1402 are horizontally arranged on a side of the porous substrate 110. The second functional portion 1402 may be used as a thermal conduction functional portion for conducting the heat to the liquid. A thermal conductivity of the second functional portion 1402 is greater than that of the atomizing portion 120 and the liquid guiding portion 130. The thermal conductivity of the second functional portion 1402 may be greater than 10 W/m·K, more specifically in a range from 30 W/m·K to 300 W/m·K. The second functional portion 1402 may be made of at least one selected from a group consisting of silicon carbide, silicon nitride, and aluminum nitride. In one embodiment, the second functional portion 1402 may be made of a material having a microporous structure, which has a function of guiding liquid. Moreover, the second functional portion 1402 has a lower porosity. For example, a pore size of the second functional portion 1402 may be in a range from 1 μm to 20 μm, and a porosity of the second functional portion 1402 may be in a range from 10% to 30%. In addition, the thermal conductivity of the material used to prepare the atomizing portion 120 and the liquid guiding portion 130 is not particularly limited, as along as the thermal conductivity of the atomizing portion 120 and the liquid guiding portion 130 are each lower than that of the second functional portion 1402.

Moreover, referring to FIG. 3, a plurality of the liquid guiding portions 130 and a plurality of the second functional portions 1402 are provided, and the number of the both are the same. Each of the liquid guiding portions 130 is surrounded by a corresponding second functional portion 1402. The plurality of second functional portion 1402 are surrounded by the atomizing portion 120. Furthermore, the plurality of second functional portions 1402 are arranged in an array; each of the second functional portions 1402 has a ring shape; and each of the liquid guiding portions 130 has a circular shape. A radius of the liquid guiding portion 130 and a ring width of the second functional portion 1402 are not particularly limited. When the porous component 100 adopts this configuration, the atomization particle size of the smoke can be made finer and more uniform, and the smoke smell can be more purely.

In addition, the plurality of liquid guiding portion 130 and the plurality of second functional portion 1402 are arranged in the atomizing portion 120 in an array. The area where the plurality of liquid guiding portion 130 and the plurality of second functional portion 1402 are arranged is small, and the area of the atomizing portion 120 is relatively large, which is beneficial to improve atomization effect, especially suitable for the liquid with good fluidity.

A plurality of the second functional portions 1402 are provided and the second functional portions 1402 has different thermal conductivity. The plurality of the second functional portion 1402 may be arranged on the porous substrate 110 according to the thermal conductivity gradient as needed, so as to regulate temperature distribution in different areas, which can effectively avoid scorching caused by overheating of the liquid during smoking, and reduce unnecessary heat loss. For example, the plurality of the second functional portion 1402 may be arranged such that the thermal conductivity thereof gradually decreases in a direction from being close to the atomized material part to away from the atomized material part 120. In addition, the arrangement and the size of each area of the plurality of second functional portions 1402 and the plurality of liquid guiding portions 130 can be designed, through combining the plurality of second functional portions 1402 and the plurality of liquid guiding portions 130 and according to an atomization temperature and a liquid supplying speed required by the different types of the liquid, which can significantly increase the matching degree of the atomizer to different types of the liquid, and improve the compatibility of the atomizer to different types of the liquid.

Figure 4:
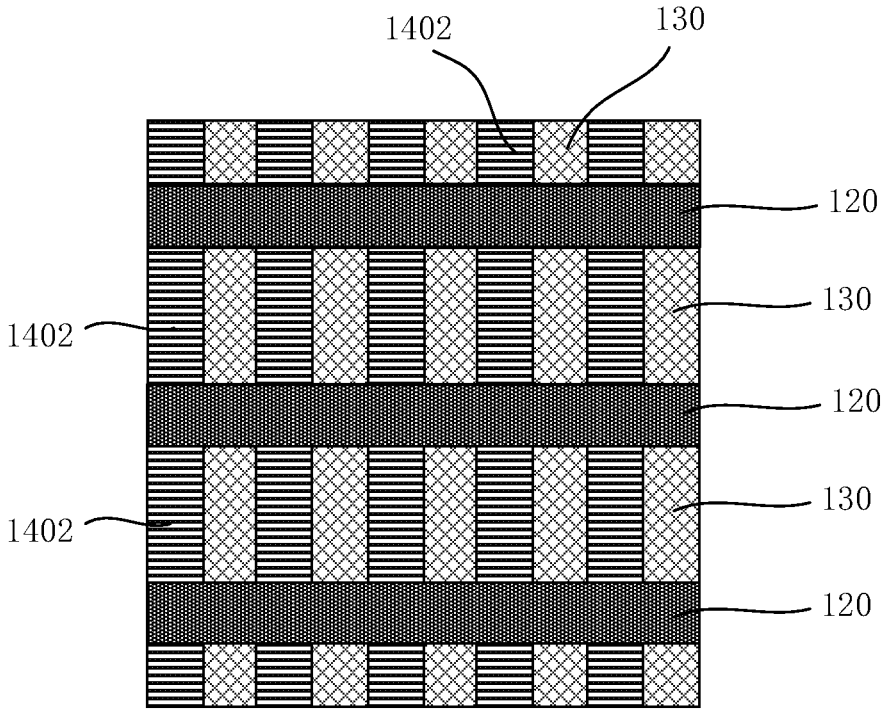
FIG. 4 is a top view of a porous component according to yet another embodiment.

In one of the embodiments, referring to FIG. 4, the functional portion 140 includes at least one second functional portion 1402. The second functional portion 1402 is connected to the atomizing portion 120 and the liquid guiding portion 130. The atomizing portion 120, the liquid guiding portion 130, and the second functional portion 1402 are horizontally arranged on a side of the porous substrate 110. More specifically, a plurality of the atomizing portion 120, a plurality of the liquid guiding portion 130, and a plurality of the second functional portion 1402 are provided. The atomizing portions 120, the liquid guiding portions 130, and the second functional portions 1402 may each have a strip shape. The plurality of atomizing portion 120 are spaced apart in parallel, the plurality of liquid guiding portions 130 and the plurality of second functional portions 1402 are alternatively arranged between two adjacent atomizing portions 120 along an extending direction thereof. The area where the plurality of liquid guiding portions 130 and the plurality of second functional portions 1402 are arranged is larger, which can increase a liquid guiding speed and an atomizing speed, and are suitable for the liquid with slightly poor fluidity. Widths of the atomizing portions 120, the liquid guiding portions 130, and the second functional portions 1402 are not particularly limited, and can be adjusted as needed. When the porous component 100 adopts this configuration, it is beneficial to further increase the atomization speed and reduce the power consumption.

Figure 5:
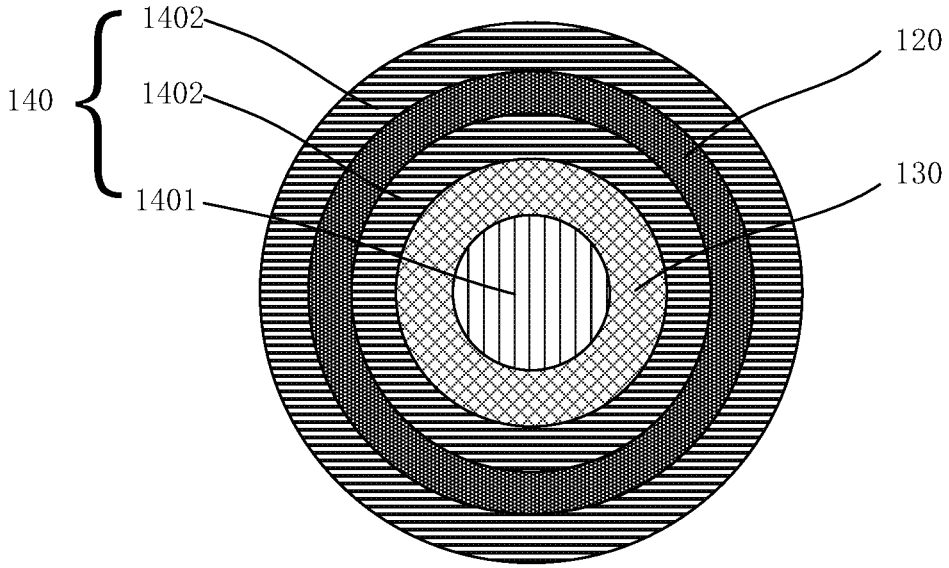
FIG. 5 is a top view of a porous component according to yet another embodiment.

In one of the embodiments, referring to FIG. 5, the functional portion 140 includes one first functional portion 1401 and two second functional portions 1402. The atomizing portion 120, the liquid guiding portion 130, the first functional portion 1401, and the second functional portions 1402 are horizontally arranged on a side of the porous substrate 110. Specifically, the first functional portion 1401 has a circular shape and is surrounded by the liquid guiding portion 130. The liquid guiding portion 130 has a ring shape concentric with the first functional portion 1401. One of the two second functional portions 1402 has a ring shape concentric with the first functional portion 1401 and surrounds the liquid guiding portion 130. The atomizing portion 120 has a ring shape concentric with the first functional portion 1401 and surrounds the inner second functional portions 1402. The other one of the two second functional portions 1402 has a ring shape concentric with the first functional portion 1401 and surrounds the atomizing portion 120. A radius of the first functional portion 1401 and ring widths of the atomizing portion 120, the liquid guiding portion 130, and the second functional portions 1402 may be adjusted within a large range. When the porous component 100 adopts this configuration, it can achieve the effects of large amount of smoke, fast atomization speed, low power consumption and the like.

Figure 6:
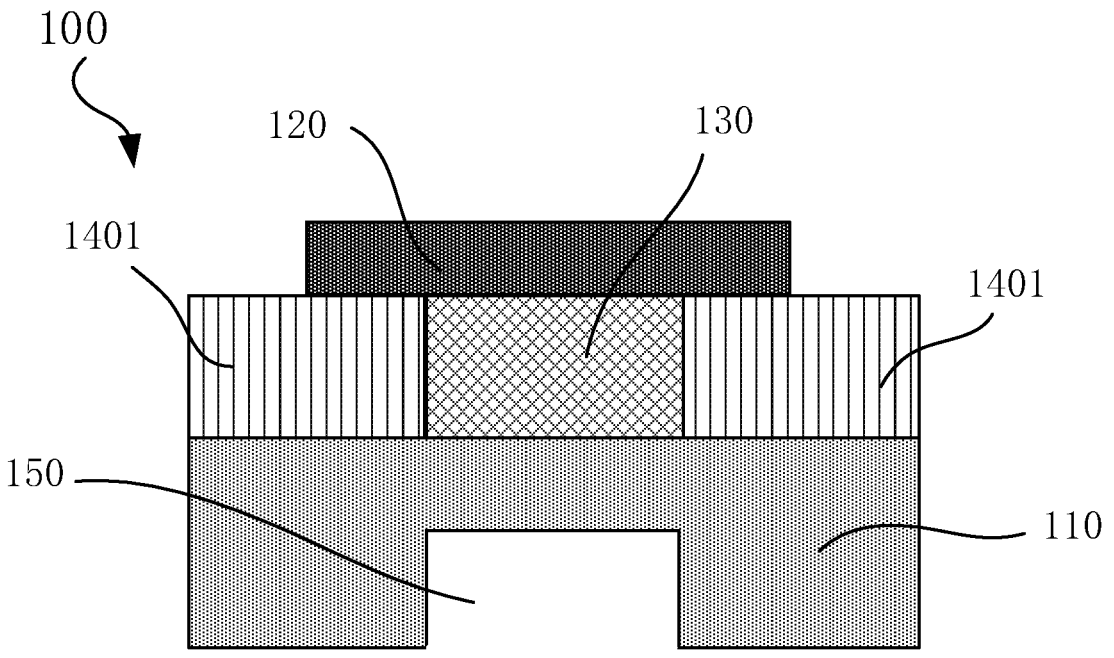
FIG. 6 is a cross-sectional view of a porous component according to yet another embodiment.

In one of the embodiments, referring to FIG. 6, the functional portion 140 includes only one first functional portion 1401. The liquid guiding portion 130 and the first functional portion 1401 are horizontally arranged on a side of the porous substrate 110. The atomizing portion 120 is laminated on the side of the liquid guiding portion 130 and the first functional portion 1401 away from the porous substrate 110. That is, the liquid guiding portion 130 and the first functional portion 1401 form a first layer on the one side of the porous substrate 110, the atomizing portion 120 forms a second layer laminated on the first layer. Moreover, a plurality of (for example, two) first functional portion 1401 may be provided. The liquid guiding portion 130 is located between two adjacent first functional portions 1401. Each of the first functional portions 1401 is in partial contact with the atomizing portion 120. Furthermore, the side of the porous substrate 110 away from the liquid guiding portion 130 and the first functional portions 1401 may be recessed inwardly, for example, may form a groove 150 for storing liquid. The size of the groove 150 may be adjusted as needed. When the porous component 100 adopts this configuration, it can effectively increase the amount of smoke, the atomization speed and the liquid guiding speed, which is beneficial to industrial applications.

Figure 7:
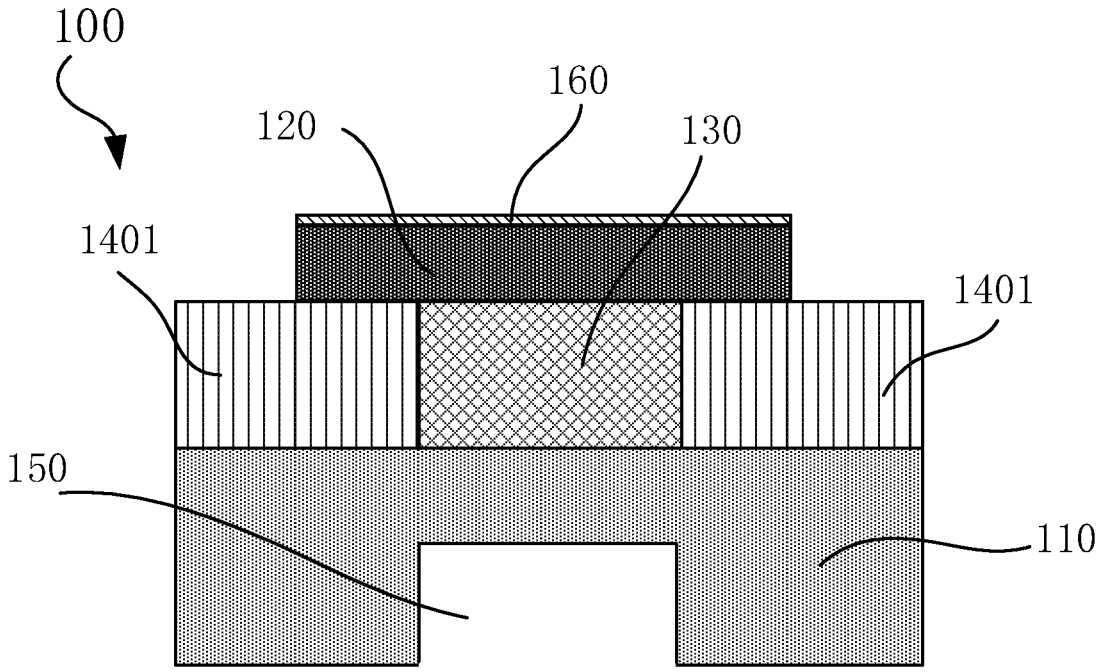
FIG. 7 is a cross-sectional view of a porous component according to yet another embodiment.

In one of the embodiments, referring to FIG. 7, the porous component 100 further includes electrically conductive tracks 160 positioned on the atomizing portion 120. The conductive tracks 160 can generate heat when power is applied. In one of the embodiments, the conductive traces 160 may be formed by screen printing metal alloy paste, such as gold and silver, gold and platinum, and then sintering it.

Through the porous component formed by combining the atomizing portion, the liquid guiding portion with the functional portion capable of ventilation and/or thermal conduction, and changing the material characteristics of the atomizing portion, the liquid guiding portion and the functional portion, it can achieve a balanced improvement in the overall property of the atomizer, and save the space occupied by the atomizer.

Each the technical features of the embodiments described above can be arbitrarily combined. In order to simplify the description, all possible combinations of each technical features in the above embodiments have not been described. However, as long as there is no contradiction in the combination of these technical features, it should be considered as that all of them fall within the scope recorded in this specification.

The above described embodiments only present several implementation manners of the present disclosure, and descriptions thereof are more specific and detailed, but they cannot be understood as limiting the scope of the application patent. It should be noted that, to those of ordinary skill in the art, several modifications and improvements can be made without departing from the concept of the present disclosure, which all fall within the protection scope of the present disclosure. Therefore, the protection scope of this application patent shall be subject to the appended claims.

What is claimed is:

1. A porous component for an electronic cigarette, the porous component comprising:

a porous substrate;

an atomizing portion located on the porous substrate;

a liquid guiding portion located on the porous substrate, a porosity of the liquid guiding portion being greater than a porosity of the atomizing portion; and a functional portion located on the porous substrate, wherein a porosity of the functional portion is greater than a porosity of the liquid guiding portion, and a thermal conductivity of the functional portion is greater than a thermal conductivity of the atomizing portion and the liquid guiding portion.

2. The porous component according to claim 1, wherein the functional portion is connected to at least one of the atomizing portion and the liquid guiding portion and comprises a first functional portion connected to the liquid guiding portion, a porosity of the first functional portion is greater than the porosity of the liquid guiding portion, the liquid guiding portion is connected to the atomizing portion; the atomizing portion, the liquid guiding portion, and the first functional portion are horizontally arranged on a side of the porous substrate.

3. The porous component according to claim 2, wherein a plurality of the liquid guiding portions and a plurality of the first functional portions are provided, each first functional portion is surrounded by a corresponding liquid guiding portion, and the plurality of liquid guiding portions are surrounded by the atomizing portion.

4. The porous component according to claim 3, wherein the plurality of first functional portions are arranged in an array, each of the first functional portions has a rectangular shape, and each of the liquid guiding portions is shaped as a rectangular frame.

5. The porous component according to claim 1, wherein the functional portion comprises a second functional portion connected to the atomizing portion and the liquid guiding portion, a thermal conductivity of the second functional portion is greater than the thermal conductivity of the atomizing portion and the liquid guiding portion; the atomizing portion, the liquid guiding portion, and the second functional portion are horizontally arranged on a side of the porous substrate.

6. The porous component according to claim 5, wherein a plurality of the liquid guiding portions and a plurality of the second functional portions are provided, each liquid guiding portion is surrounded by a corresponding second functional portion, and the plurality of second functional portions are surrounded by the atomizing portion.

7. The porous component according to claim 6, wherein the plurality of second functional portions are arranged in an array, each of the second functional portions has a ring shape, and each of the liquid guiding portions has a circular shape.

8. The porous component according to claim 5, wherein a plurality of the atomizing portion, a plurality of the liquid guiding portion and a plurality of the second functional portion are provided, the plurality of atomizing portion are spaced apart in parallel, the plurality of liquid guiding portions and the plurality of second functional portions are alternatively arranged between two adjacent atomizing portions along an extending direction thereof.

9. The porous component according to claim 1, wherein the functional portion comprises a first functional portion and a second functional portion, the first functional portion is connected to the liquid guiding portion, the second functional portion is connected to at least one of the atomizing portion and the liquid guiding portion; the atomizing portion, the liquid guiding portion, the first functional portion, and the second functional portion are horizontally arranged on a side of the porous substrate.

10. The porous component according to claim 9, wherein the first functional portion is surrounded by the liquid guiding portion, a plurality of the second functional portion are provided, the liquid guiding portion is surrounded by at least one second functional portion, and at least one second functional portion is surrounded by the atomizing portion, the atomizing portion is surrounded by at least one second functional portion.

11. The porous component according to claim 10, wherein the first functional portion has a circular shape, the atomizing portion, the liquid guiding portion, and the second functional portions each has a ring shape concentric with the first functional portion.

12. The porous component according to claim 1, wherein the functional portion comprises a first functional portion, the liquid guiding portion and the first functional portion are horizontally arranged on a side of the porous substrate, the atomizing portion is laminated on a side of the liquid guiding portion and the first functional portion away from the porous substrate.

13. The porous component according to claim 12, wherein a plurality of the first functional portion are provided, the liquid guiding portion is located between two adjacent first functional portions, each of the first functional portions is in partial contact with the atomizing portion.

14. The porous component according to claim 12, wherein a side of the porous substrate away from the liquid guiding portion and the first functional portions forms a groove for storing liquid.

15. The porous component according to claim 1, wherein a porosity of the atomizing portion is less than 20%, a porosity of the liquid guiding portion is in a range from 20% to 60%, a porosity of the functional portion is in a range from 40% to 70%, a thermal conductivity of the functional portion is greater than 10 W/m·K, a pore size of the porous substrate is in a range from 10 μm to 50 μm, a porosity of the porous substrate is in a range from 30% to 70%.

16. The porous component according to claim 1, wherein the atomizing portion is made of at least one selected from a group consisting of alumina ceramic, silicon oxide ceramic, zirconia ceramic, silicon nitride ceramic, cordierite ceramic, silicon carbide ceramic, aluminum titanate ceramic, spodumene ceramic, and mullite ceramic, the liquid guiding portion is made of at least one selected from a group consisting of alumina ceramic, cordierite ceramic, diatomaceous earth ceramic, and silicon carbide ceramic, the porous substrate is made of at least one selected from a group consisting of porous ceramic and porous metal.

17. The porous component according to claim 2, wherein the first functional portion is made of the alumina ceramic.

18. The porous component according to claim 5, wherein the second functional portion is made of at least one selected from a group consisting of silicon carbide, silicon nitride, and aluminum nitride.

19. The porous component according to claim 1, wherein the functional portion is connected to at least one of the atomizing portion and the liquid guiding portion, the porous component further comprises electrically conductive tracks positioned on the atomizing portion.

20. An electronic cigarette, comprising:

a porous component, the porous component comprising:

a porous substrate;

an atomizing portion located on the porous substrate;

a liquid guiding portion located on the porous substrate, a porosity of the liquid guiding portion being greater than a porosity of the atomizing portion; and a functional portion located on the porous substrate, wherein a porosity of the functional portion is greater than a porosity of the liquid guiding portion, and a thermal conductivity of the functional portion is greater than a thermal conductivity of the atomizing portion and the liquid guiding portion.

* * * * *